US005634813A

United States Patent [19]

Patel et al.

[11] Patent Number: 5,634,813

[45] Date of Patent: Jun. 3, 1997

[54] CRIMPABLE ELECTRICAL TERMINAL

[75] Inventors: Arvind Patel, Naperville; Robert A. Klemmer, Wheaton, both of Ill.

[73] Assignee: Molex Incorporated, Lisle, Ill.

[21] Appl. No.: 572,279

[22] Filed: Dec. 13, 1995

[51] Int. Cl.[6] ..... H01R 4/24

[52] U.S. Cl. ..... 439/422; 439/741

[58] Field of Search ..... 439/421, 422, 439/423, 424, 877, 442, 861, 862, 741

[56] References Cited

U.S. PATENT DOCUMENTS

| | | | |
|---|---|---|---|
| 3,395,381 | 7/1968 | Huffnagle | 339/97 |
| 3,697,925 | 10/1972 | Henschen | 339/17 |
| 3,713,072 | 1/1973 | Henschen et al. | 339/17 |
| 3,933,405 | 1/1976 | Patterson, Jr. et al. | 439/862 |
| 4,082,402 | 4/1978 | Kinkaid et al. | 339/97 |
| 4,561,714 | 12/1985 | Byczek et al. | 339/97 |
| 5,078,617 | 1/1992 | Gutierrez et al. | 439/422 |

*Primary Examiner*—Neil Abrams
*Assistant Examiner*—Tho D. Ta
*Attorney, Agent, or Firm*—Stephen Z. Weiss

[57] ABSTRACT

An electrical terminal is adapted for use with an electrical conductor. The terminal has a terminating portion with a generally U-shaped cross-section having a web and a pair of sidewalls extending from two opposite longitudinal edges of the web. The sidewalls are generally trapezoidally shaped with relatively wide bases, joined to the longitudinal edges of the web, and relatively narrow tips. The bases are transversely aligned across the web. The tips are offset across the web so that the tips are spaced longitudinally of the web. Therefore, the tips will bypass each other when crimped toward each other to terminate the electrical conductor, all within the longitudinal confines of the bases of the sidewalls.

5 Claims, 5 Drawing Sheets

CRIMPABLE ELECTRICAL TERMINAL

FIELD OF THE INVENTION

This invention generally relates to the art of electrical connectors and, particularly, to a crimpable electrical terminal for terminating an electrical conductor, such as a flat flexible circuitry.

BACKGROUND OF THE INVENTION

Electrical terminals are used in a wide variety of applications for terminating electrical conductors so that the conductors can be connected to other electrical devices. The terminals often have contact portions whereby the terminated conductors are connected to the other electrical devices through interengagement of the contact portions of mating terminals.

With the ever-increasing miniaturization of contemporary electronics and electrical devices, it continuously becomes increasingly difficult to design electrical terminals which meet the dimensional parameters or size restrictions required in many applications. In other words, the electrical terminals have become smaller and smaller, resulting in many design difficulties.

For example, cellular or mobile telephones have become increasingly smaller in size or overall dimensions. Correspondingly, the battery packs for such telephones are a fraction of the size of battery packs only a few years ago. These battery packs require electrical terminals which, in turn, also must be considerably miniaturized. Such miniaturization creates all kinds of problems in terminal configuration and design. For instance, heretofore, the terminals in a battery pack for a cellular or mobile telephone most often were soldered to the conductors of flat flexible cables within the pack. Because of the miniaturization, such soldering techniques have become increasingly difficult, if at all possible since the high temperature for soldering could destroy the conductor on the flat flexible circuitry. Consequently, crimp terminals have been considered for such uses.

Heretofore, crimp terminals most often have included a channel-shaped terminating portion for receiving the electrical conductor to be terminated. The channel-shaped terminating portion includes a base or web, with a pair of sidewalls extending from the two opposite longitudinal edges of the web. The sidewalls are crimped inwardly toward each other for terminating the electrical conductor. If the sidewalls are disposed diametrically opposite each other, i.e. transversely across the web, obviously the web and, in turn, the terminating portion of the terminal must be sufficiently wide to allow the sidewalls to be fully bent inwardly toward the opposite sidewalls. In order to reduce the width of the terminating crimp portion of the terminal, the crimpable sidewalls have been staggered lengthwise of the terminal so that the sidewalls can be crimped in a fashion to bypass each other when crimped generally toward each other. However, when the sidewalls are staggered to reduce the width of the terminal, the length of the terminal then is made longer than if the sidewalls were diametrically opposite each other. This dilemma has caused considerable comprises in reducing the overall dimensions of such crimpable terminals.

The present invention is directed to solving the above problems in a crimpable electrical terminal which has reduced dimensional parameters than heretofore has been available in the prior art.

SUMMARY OF THE INVENTION

An object, therefore, of the invention is to provide a new and improved crimpable electrical terminal of the character described, for terminating an electrical conductor.

In the exemplary embodiment of the invention, the electrical terminal includes a contact portion at one end and a terminating portion at an opposite end. The contact portion and the terminating portion form an elongated unitary structure, such as of stamped and formed sheet metal material. The terminating portion is generally U-shaped in cross-section and includes a web and a pair of sidewalls extending from two opposite longitudinal edges of the web. The sidewalls have a general trapezoid shape with relatively wide bases, joined to the longitudinal edges of the web, and relatively narrow tips. The bases are transversely aligned across the web. The tips are offset across the web such that the tips are spaced longitudinally of the web. Therefore, the tips will bypass each other when crimped toward each other to terminate the electrical conductor, all within the longitudinal confines of the bases of the sidewalls.

The electrical terminal is shown herein adapted for use with a flat flexible circuit. The terminal also includes a contact portion which is generally channel-shaped in cross-section generally transverse to the terminating portion.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which:

DETAILED DESCRIPTION OF THE PREFERRED EMBODIMENT

Figure 1:
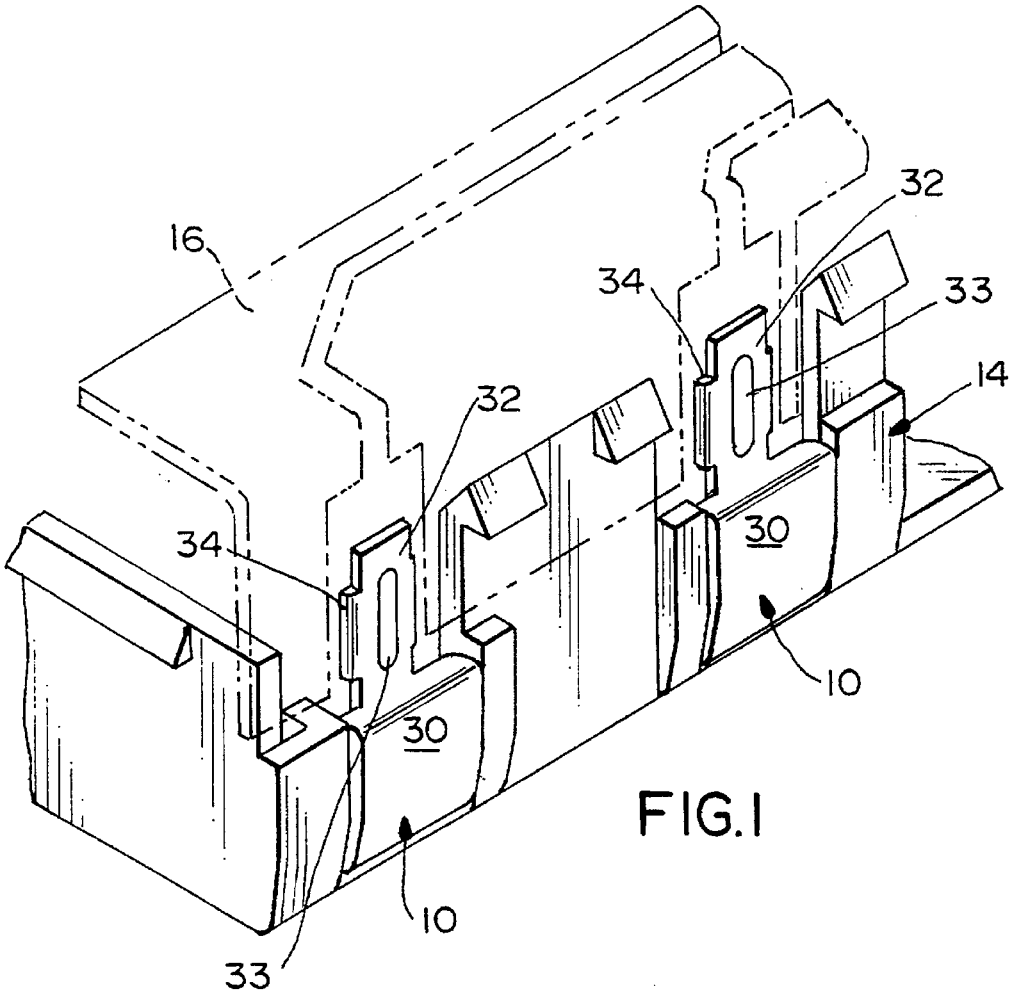
FIG. 1 is a perspective view of a portion of a battery pack housing onto which a pair of the electrical terminals according to the invention have been mounted.

Referring to the drawings in greater detail, and first to FIG. 1, the invention is embodied in a crimpable electrical terminal, generally designated 10, which is shown mounted to a wall 12 (FIG. 2) of a frame, generally designated 14 (FIG. 1), of a battery pack for a cellular or mobile telephone.

The entire battery pack is not shown in the drawings, but frame 14 is sufficient for a clear and concise understanding of the invention as embodied in terminal 10. Two of the terminals are shown mounted to frame 14 in FIG. 1. Generally, each terminal 10 is adapted for terminating to a flat flexible circuit 16 shown in phantom.

The term "flat flexible circuit" is used herein in a generic sense to include conductors in conventional flexible flat cables and flexible circuitry of the type produced by etching or otherwise. Conductors of these types include flat conductors encased in an insulating film such as Mylar (polyethyleneterephthalate). Of course, it should be understood that the concepts of the invention herein for considerably reducing the dimensions of a crimpable electrical terminal are equally applicable for use with a wide variety of electrical conductors.

Figure 2:
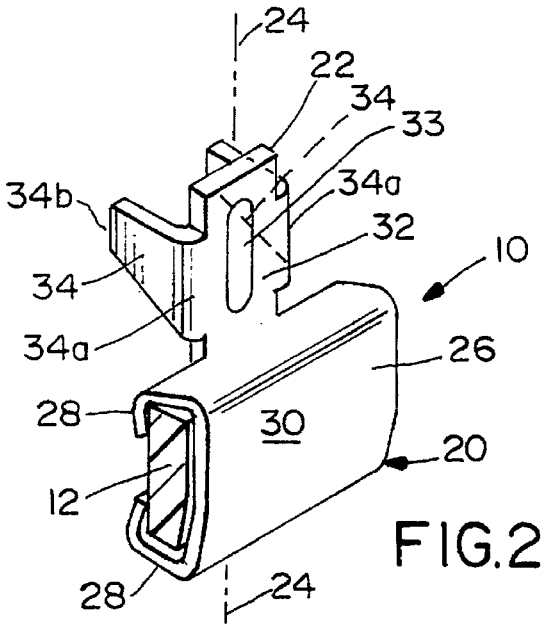
FIG. 2 is a perspective view of one of the terminals mounted to a plastic wall of the battery pack housing.
Figure 3:
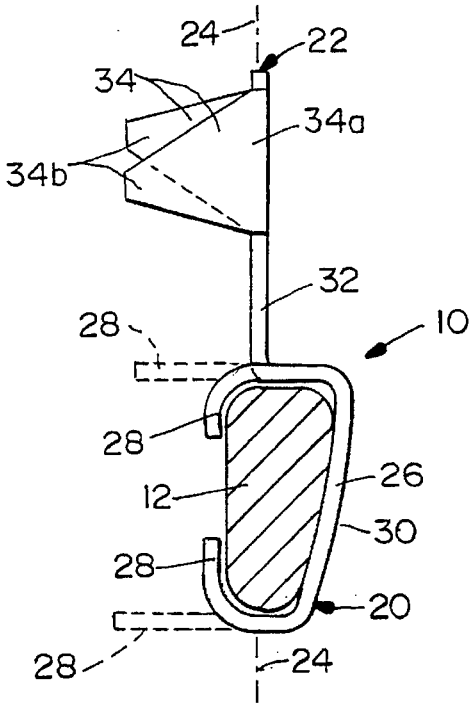
FIG. 3 is a side elevational view looking toward the left-hand side of FIG. 2.

Referring to FIG. 3 in conjunction with FIGS. 1 and 2, each crimpable electrical terminal 10 includes a contact portion, generally designated 20, at one end of the terminal, and a terminating portion, generally designated 22, at the opposite end of the terminal. Contact portion 20 and terminating portion 22 form an elongated unitary structure which can be fabricated of stamped and formed sheet metal material. The contact and terminating portions generally define a longitudinal axis 24 of the terminal.

Contact portion 20 is generally channel-shaped in cross-section generally transverse to terminating portion 22 and longitudinal axis 24 as seen best in FIGS. 2 and 3. The channel-shaped portion includes a base 26 and a pair of legs 28. Base 26 is generally flat (actually, slightly curved) to form a contact surface 30 which is engageable with a complementary contact within the telephone (not shown). Legs 28 are adapted for bending and clamping about wall 12 of frame 14. The legs are shown in phantom in FIG. 3 projecting rearwardly of base 26 in a straight configuration to allow the terminal to be mounted onto the front of wall 12. When so mounted, the legs are bent toward each other as shown in full lines in FIG. 3 to embrace wall 12 and securely mount the terminal to frame 14.

Terminating portion 22 of terminal 10 is generally U-shaped in cross-section and includes a web 32 an elongated dimple 33, and a pair of side walls extending from the two opposite longitudinal edges of the web. The side walls are generally trapezoidally shaped with relatively wide base portions **34*a*, joined to the longitudinal edges of web 32, and relatively narrow tips 34*b* which have beveled edges. It can be seen quite clearly in FIG. 3 that bases 34*a* of sidewalls 34 are transversely aligned across web 32, i.e. transversely of longitudinal axis 24. This enables the terminating portion of the terminal to have as short a dimension as possible, i.e. in contrast to longitudinally offsetting the bases of the sidewalls. On the other hand, tips 34*b* of sidewalls 34 are offset transversely of web 32 (i.e. longitudinally of axis 24) such that the tips are spaced longitudinally of the web. Therefore, the tips will bypass each other when crimped toward each other to terminate electrical conductor 16**. This allows for the terminating portion of the terminal to be as narrow as possible.

Figure 4:
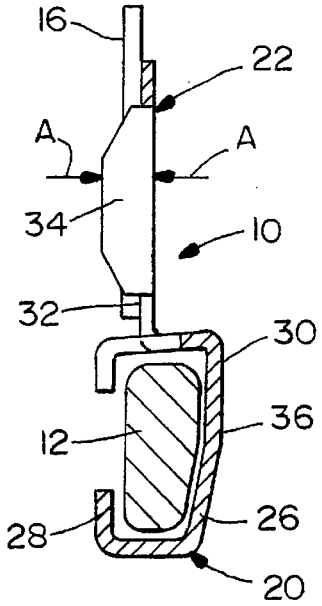
FIG. 4 is a fragmented vertical section similar to the elevational view of FIG. 3, but with the sidewalls of the terminal crimped about the flat flexible circuit.
Figure 12:
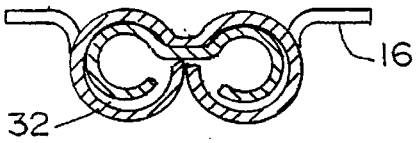
Figure 11:
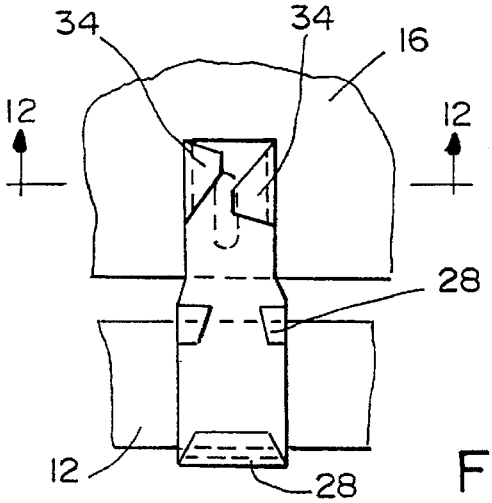
FIG. 11 is an elevation view of the terminal attached to the dielectric material and the flat flexible cable and FIG. 12 has a top view of the terminal of FIG. 11.

FIG. 4 shows sidewalls 34 of one of the terminals 10 crimped onto flat conductor cable 16. Arrows "A" indicate the crimped "height" of the terminating portion 22 of the terminal. FIG. 4 also shows that a contact plating 36 can be applied to surface 30 of base 26 of the contact portion 20 of the terminal.

Figures 5, 6:
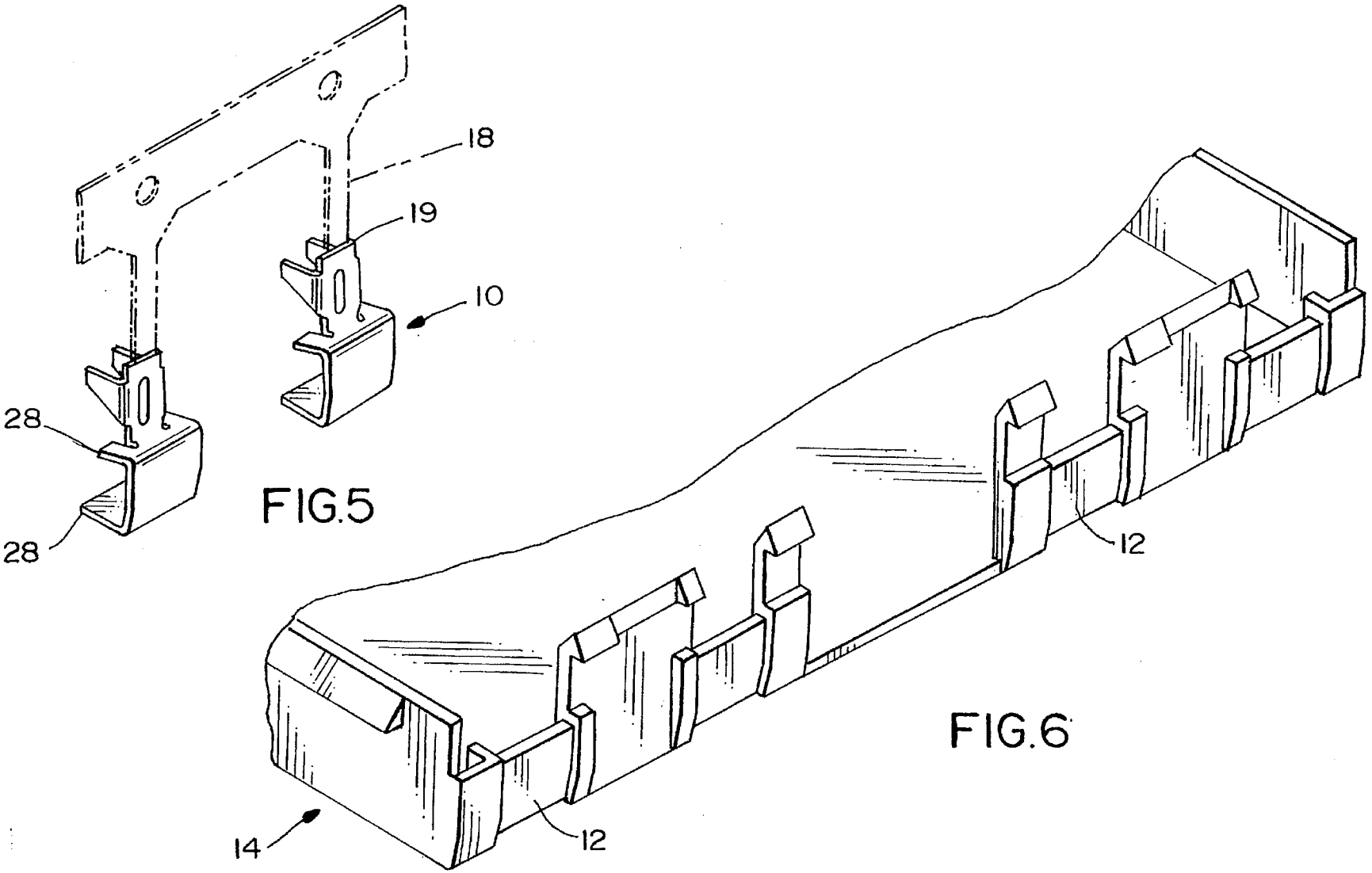
FIG. 5 is a perspective view of the stamped terminal attached to its carrier.
FIG. 6 is a perspective view of the battery pack housing without terminals.
Figure 7:
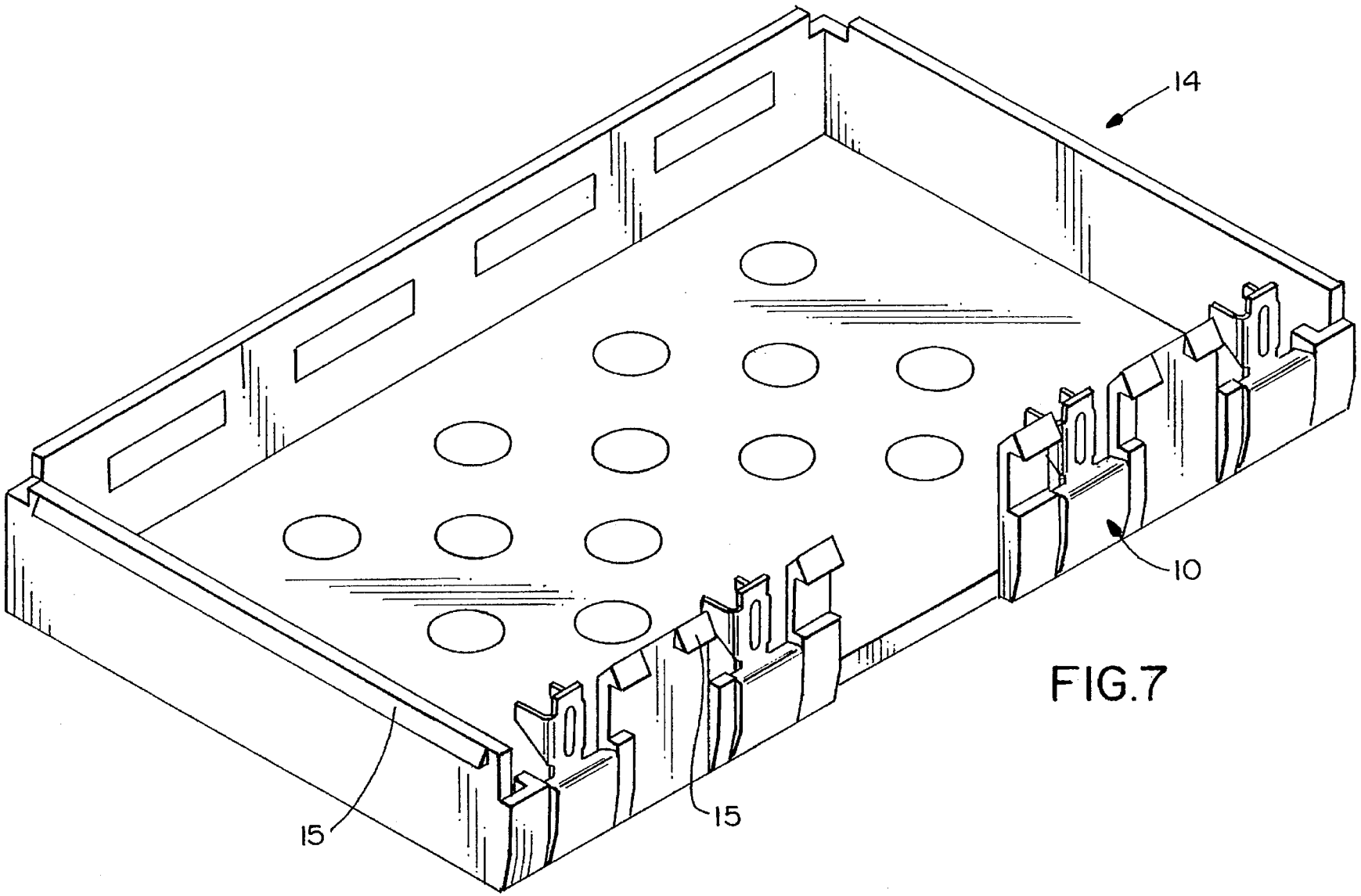
FIG. 7 is a perspective view of the battery pack with terminals prior to being crimped to the flat flexible circuit.

FIG. 5 shows the terminal 10 after it is stamped and formed. The carrier strip 18 which is manufactured with the terminal 10 is shown in phantom. The carrier strip is used to conveniently gang load the terminal on to wall 12 of frame 14. This carrier is severed from the terminal at cut 19 after the terminal is fully mounted to frame 14 with legs 28 bent around wall 12. FIG. 6 shows the frame 14 without any terminals mounted to it. FIG. 7 is a more complete view of frame 14 showing terminals 10 mounted thereon and the carrier strip already severed. An electrical device such as a battery (not shown) is held within this frame. Also shown on frame 14 are locking ledges 15 upon which a cover (not shown) may snap.

Figure 8:
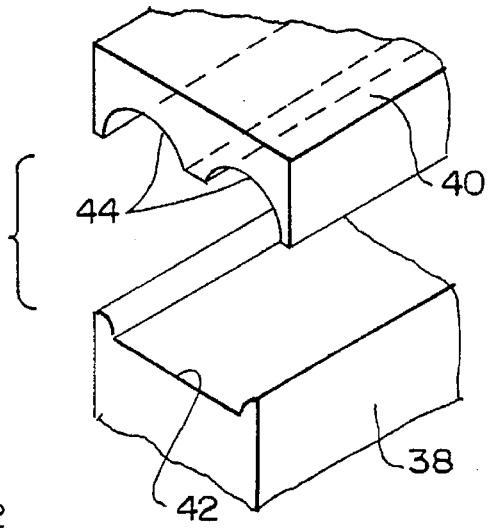
FIG. 8 is a fragmented perspective view of an anvil and a punch for crimping the terminal of FIGS. 1–4.
Figure 9:
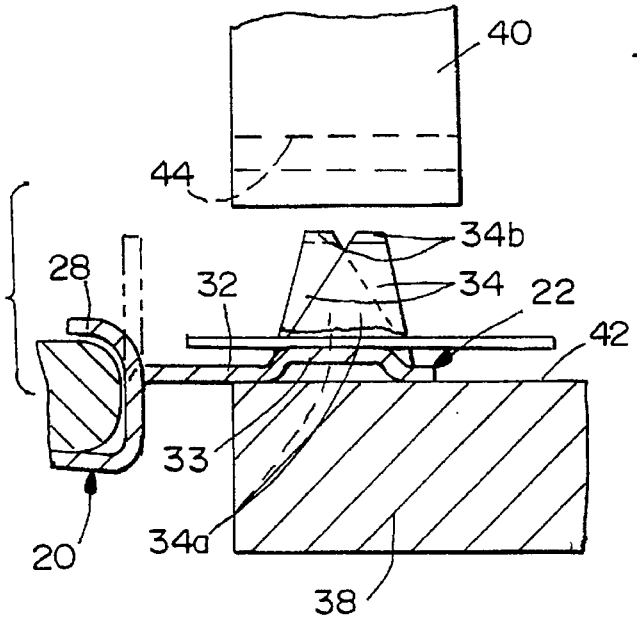
FIG. 9 is a fragmented side elevational view of one of the terminals positioned between the anvil and the punch.
Figure 10:
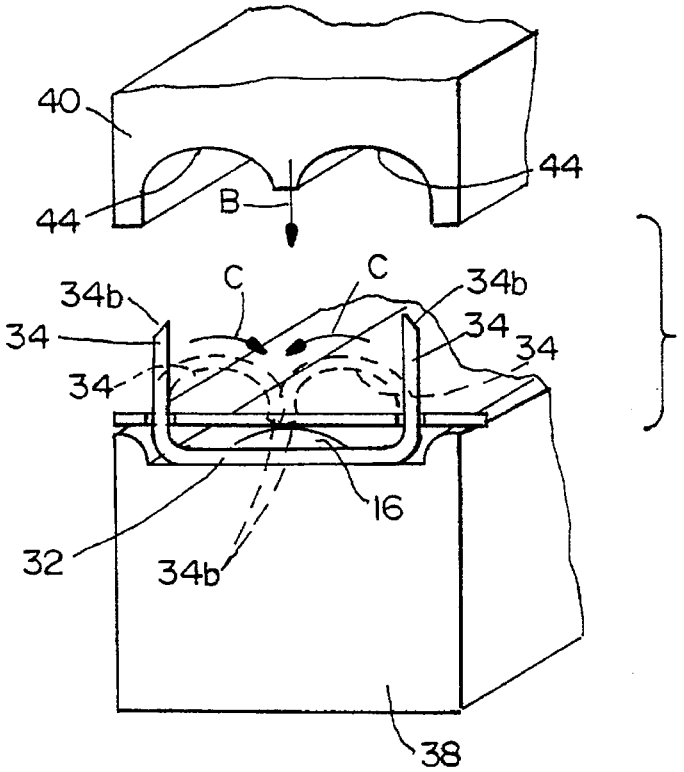
FIG. 10 is an end elevational view somewhat schematically showing the terminal between the anvil and the punch.

FIGS. 8–10 show an anvil 38 and a punch 40 of a type for crimping terminating end 22 of one of the terminals 10. Anvil 38 includes a trough 42 into which web 32 of the terminal is positioned. Punch 40 includes a dual-radius forming surface 44 for engaging and crimping sidewalls 34 of the terminal toward each other.

FIG. 9 shows one of the terminals 10 mounted such that terminating portion 22 is located between anvil 38 and punch 40, with the web 32 resting on the anvil and sidewalls 34 projecting upwardly toward the punch. The contact portion 20 of the terminal would be positioned in an appropriate jig (not shown). In fact, the entire frame 14 (FIG. 1) can be placed into a jig after the terminals are mounted thereon, and the terminals can be crimped onto their respective flat conductor cables 16 simultaneously in a two-position press.

FIG. 10 shows an end view of the terminal positioned between anvil 38 and punch 40 with sidewalls 34 projecting upwardly toward the punch. As the punch is moved downwardly toward the anvil in the direction of arrow "B", curved forming surfaces 44 engage tips **34*b* of the sidewalls and bend or form the tips inwardly in the direction of arrows "C". Eventually, sidewalls 34 will be crimped or formed as shown in phantom in FIG. 10, with tips 34*b* of the sidewalls curved completely under and into engagement with flat conductor cable 16**.

During the crimping operation, tips **34*b* of sidewalls 34 will be crimped or bent inwardly toward each other and bypass each other until the tips reach their eventual terminating positions against the flat conductor cable as shown in FIG. 10. If the tips were not offset longitudinally of the terminal as is contemplated by the present invention, the terminating end 22 of the terminal, including web 32, would have to be made considerably wider as can be understood from the depiction of FIG. 10**, in order for the tips of the sidewalls to move in an arcuate path into their eventual curved and crimped terminating positions.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical terminal adapted for use with a flat conductor cable, the terminal having a terminating portion and a contact portion of the terminal at one end of the terminating portion, the terminating portion with a generally U-shaped cross-section comprising a web and a pair of sidewalls extending from two opposite longitudinal edges of the web, the sidewalls being generally triangularly shaped with relatively wide bases and relatively narrow tips, the bases being transversely aligned across the web, and the tips being offset across the web so as to be spaced longitudinally of the web, whereby the tips will bypass each other when crimped toward each other to terminate the flat conductor cable, the contact portion being generally channel-shaped in cross-section generally transverse to the terminating portion comprising a generally flat contact surface with legs extending from the contact surface adapted to be fixed to a dielectric material.

2. The electrical terminal of claim 1 wherein the terminal is stamped and formed of sheet metal material.

3. The electrical terminal of claim 2 wherein the legs extending from the contact surface are bent around edges of the dielectric material.

4. A crimpable electrical terminal for terminating an electrical conductor, comprising:

a contact portion at one end of the terminal;

a terminating portion at an opposite end of the terminal;

the contact portion and the terminating portion forming an elongated unitary structure of stamped and formed sheet metal material;

the terminating portion being generally U-shaped in cross-section and including a web and a pair of sidewalls extending from two opposite longitudinal edges of the web;

the sidewalls being generally triangularly shaped with relatively wide bases, joined to the longitudinal edges of the web, and relatively narrow tips;

the bases being offset across the web such that the tips are spaced longitudinally of the web;

the tips being offset across the web such that the tips are spaced longitudinally of the web;

whereby the tips will bypass each other when crimped toward each other to terminate the electrical conductor; and the contact portion being generally channel-shaped in cross-section generally transverse to the terminating portion and including a generally flat contact surface with legs extending from the contact surface adapted to be fixed to a dielectric material.

5. The crimpable electrical terminal of claim 4 wherein the legs extending from the contact surface are bent around edges of the dielectric material.

* * * * *